United States Patent [19]

Hutter

[11] 4,305,638

[45] Dec. 15, 1981

[54] COAXIAL CONNECTOR WITH GASKETED SEALING CYLINDER

[75] Inventor: Harold G. Hutter, Brookfield, Conn.

[73] Assignee: Bunker Ramo Corporation, Oak Brook, Ill.

[21] Appl. No.: 963,247

[22] Filed: Nov. 22, 1978

Related U.S. Application Data

[63] Continuation of Ser. No. 835,256, Sep. 21, 1977, abandoned.

[51] Int. Cl.[3] ..... H01R 17/04

[52] U.S. Cl. ..... 339/177 R

[58] Field of Search ..... 339/177 R, 177 E; 174/89

[56] References Cited

U.S. PATENT DOCUMENTS

| | | | |
|---|---|---|---|
| 2,829,357 | 4/1958 | Lorch et al. | 339/61 |
| 2,878,458 | 3/1959 | Jackson | 339/177 |
| 2,937,360 | 5/1960 | True | 339/177 |
| 3,076,169 | 1/1963 | Blaisdell | 339/89 |
| 3,104,145 | 9/1963 | Somerset | 339/177 |
| 3,107,135 | 10/1963 | Keil | 339/103 |
| 3,110,756 | 11/1963 | Genung et al. | 339/177 R |
| 3,136,843 | 6/1964 | Pomerantz | 339/177 R |
| 3,170,748 | 2/1965 | Van Horssen | 339/88 |
| 3,184,706 | 5/1965 | Atkins | 339/177 R |
| 3,192,308 | 6/1965 | Van Horssen et al. | 174/89 |
| 3,474,391 | 10/1969 | Gartzke et al. | 339/103 |
| 3,517,371 | 6/1970 | Buckley | 339/89 |
| 3,603,912 | 9/1971 | Kelly | 339/89 C |
| 3,681,739 | 8/1972 | Kornick | 339/94 C |
| 3,697,930 | 10/1972 | Shirey | 339/89 C |
| 3,706,958 | 12/1972 | Blanchenot | 339/177 E |
| 3,761,870 | 9/1973 | Drezin | 339/177 R |
| 3,778,535 | 12/1973 | Forney, Jr. | 174/88 C |
| 3,904,264 | 9/1975 | Oertle | 339/94 C |
| 3,910,673 | 10/1975 | Stokes | 339/177 R |
| 3,954,321 | 5/1976 | Casper | 339/177 R |

FOREIGN PATENT DOCUMENTS

| | | |
|---|---|---|
| 1105941 | 9/1969 | Fed. Rep. of Germany . |
| 1109260 | 4/1968 | United Kingdom . |
| 1243572 | 8/1971 | United Kingdom . |
| 1280144 | 7/1972 | United Kingdom . |
| 1414296 | 11/1975 | United Kingdom . |

*Primary Examiner*—Neil Abrams

*Attorney, Agent, or Firm*—F. M. Arbuckle; P. D. Ertel

[57] ABSTRACT

A coaxial connector for a coaxial cable of the type having an inner conductor encircled by an annular insulating layer, an outer conductor, and an insulating jacket has a metal body with a rear opening for receiving the cable. A rear clamp nut threadingly engageable with the rear opening moves axially within the opening upon rotation to provide an axial force. A clamping ring and a stationary ring securely hold the outer conductor therebetween upon application of the axial force to the clamping ring. A cylindrical rigid member which has compressive material covering its inner surface, outer surface and one end surface and which is coaxial with the cable is disposed between the rear clamp nut and the clamp ring. As a result, when the rear clamp nut is rotated relative to the body, the cylindrical end surface cuts through the compressible material which is compressed by the axial force provided by the rear clamp nut to provide a seal between the rear opening and the cable. Thereafter, the cylinder applies the axial force to the clamping ring to thereby cause the coaxial cable outer conductor to be securely held by the clamping ring and the stationary ring.

14 Claims, 3 Drawing Figures

COAXIAL CONNECTOR WITH GASKETED SEALING CYLINDER

This is a continuation of application Ser. No. 835,256, filed Sept. 21, 1977, now abandoned.

BACKGROUND OF THE INVENTION

The present invention is directed generally to a coaxial connector and more particularly to a coaxial connector having an improved arrangement for securely holding the cable and sealing the interior of the connector from the external environment.

There are many applications where it is necessary to terminate a coaxial cable of the type having an inner conductor encircled by an annular insulating layer, an outer conductor, and an insulating jacket with a coaxial connector which is adapted to interfit with a complementary mating connector. To insure proper electrical characteristics, the termination between the cable and connector must provide a low resistance connection between the inner and outer cable conductors and corresponding inner and outer connector contacts. Furthermore, to protect the integrity of the electrical connections, the cable must be securely held by the connector so that the cable cannot be inadvertently pulled out of the connector. Also, the cable-connector interconnections must be sealed from the external environment to prevent degradation of the interconnections and the connector component parts.

While prior art techniques and connector constructions have been generally successful towards achieving these ends, they have only been so successful for relatively large connectors. The prior art connectors have generally included a great number of component parts to provide adequate cable retention and connector sealing. Because a great number of parts are required, only larger connectors have adequate inner space for accommodating both the many component parts and the cable to be terminated. Connectors of smaller size do not, because of their small size, provide adequate space for incorporating both the large number of prior art component parts and the cable to be terminated.

Even where the large connectors have adequate space to incorporate prior art constructions for cable retention and connector sealing, they are relatively expensive owing to the great number of required component parts. Furthermore, because coaxial connectors find considerable applications in field-type environments, it is most desirable to be able to easily service them in the field without the need for replacement parts or special tools. Field servicing of prior art connectors has been difficult, if not impossible, because the connector component parts are not only many in number, but also are fragile. As a result, some component parts may not be reusable and damage of the fragile component parts during field servicing is likely. Also, in many cases, special tools are required to reassemble the connectors and terminate cables to them. Thus, the availability of replacement parts and special tools is generally required which, as mentioned above, is most undesirable from a field servicing standpoint, It is therefore a general object of the present invention to provide a coaxial connector which includes an improved arrangement for effecting cable retention and connector sealing.

It is a further object of the present invention to provide a coaxial cable connector having fewer component parts than required by prior art constructions for providing cable retention and connector sealing.

It is a still further object of the present invention to provide a coaxial cable connector which is less expensive than prior art connectors and which is readily field servicable.

SUMMARY OF THE INVENTION

The invention provides a coaxial connector for a coaxial cable having an inner conductor encircled by an annular insulating layer, an outer conductor, and an insulating jacket comprising a metallic body having an opening therein for receiving the coaxial cable, force generating means for providing an axial force, clamping means within the opening for securely holding the outer conductor responsive to the axial force, and force applying means including a rigid member for applying the axial force to the clamping means to cause the clamping means to securely hold the outer conductor and thus securely retain the coaxial cable and resilient means communicating with the coaxial cable and the opening and compressed by the axial force to provide a seal between the coaxial cable and the opening.

BRIEF DESCRIPTION OF THE DRAWINGS

The invention, together with the objects and advantages thereof, may best be understood by reference to the following description taken in conjunction with the accompanying drawings, and in the several figures of which like reference numerals identify like elements, and in which.

DESCRIPTION OF THE PREFERRED EMBODIMENT

Figure 1:
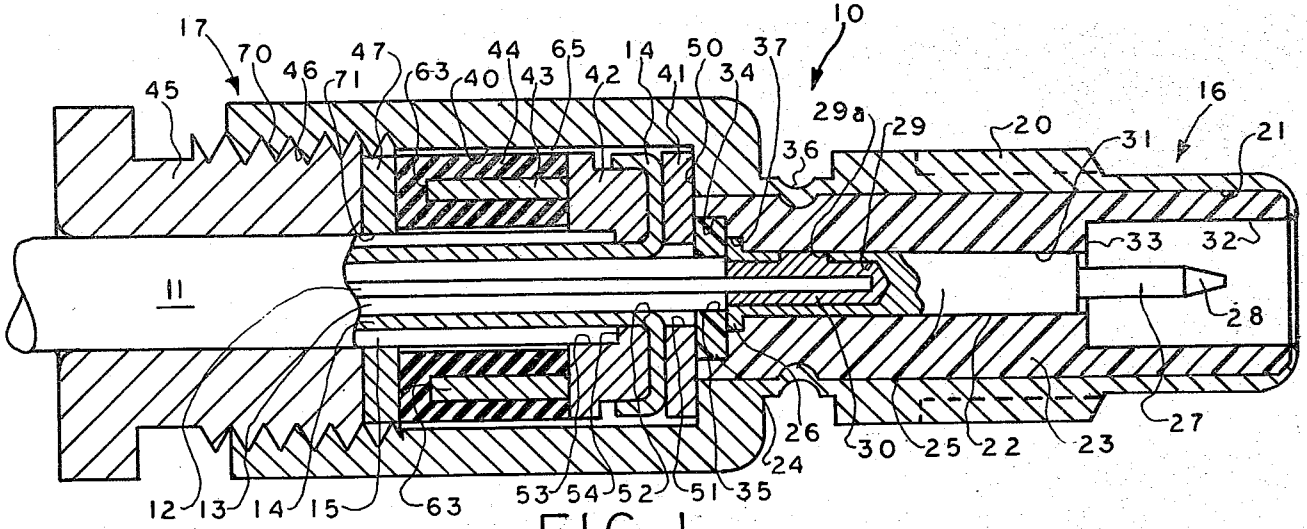
FIG. 1 is a cross-sectional view of a coaxial cable connector embodying the present invention illustrating the component parts of the connector prior to a last remaining termination operation for terminating the coaxial cable to the connector.

FIG. 1 illustrates a coaxial cable connector embodying the present invention prior to a last remaining cable termination operation which provides cable retention and connector sealing. The connector generally designated at 10 is of the type which is most particularly applicable for terminating a coaxial cable 11 having an inner conductor 12, an annular insulating layer 13 encircling the inner conductor 12, an outer conductor 14 commonly referred to as the braid of the cable, and an insulating jacket 15. The connector 10 includes a generally cylindrical metallic body having a forward end 16 and a rearward end 17 which is larger in diameter dimension than the forward end 16.

The forward end 16 has an outer threaded portion 20 which is adapted to threadingly engage a rotatable ring having a corresponding inner thread carried by a mating connector for securely locking the connectors together. The forward end 16 also includes a cylindrical bore 21 which houses the center contact pin 22 of the connector and its associated insulating members 23 and 24.

The center contact pin 22 is formed from a conductive material such as brass or stainless steel and includes a main cylindrical body portion 25 which has a flanged rear end 26. The pin 22 includes at its forward end a cylindrical extension 27 which terminates in a pointed tip end 28. The main body 25 includes a hollowed out portion 29 which includes a small opening 29a so that solder 30 may be flowed into the hollowed out portion 29 for the purpose of establishing a low resistance connection between center conductor 12 and the center contact pin 22.

The center contact pin 22 is supported within the forward opening 21 by the insulating member 23 which is generally cylindrical in shape and formed from a dielectric material, such as the synthetic resin polymer sold under the trademark Teflon, for example. Insulating member 23 has an outer diameter dimension corresponding to the inner diameter dimension of opening 21 and includes a main bore 31 having an inner diameter dimension corresponding to the outer diameter dimension of the main body portion 25 of center contact pin 22. Insulating member 23 also has a counterbore 32 which extends from the forward end of the connector to a shoulder portion 33 to provide sufficient space for a mating connector to make contact with the cylindrical extension 27 of center contact pin 22. A second counterbore 37 is provided in the rearward end of insulating member 23, annular to bore 31, for accommodating flange 26 of the center contact pin 22 to restrict forward movement of the center contact pin. A third counterbore 34 which communicates with the second counterbore 37 and which is greater in diameter than the second counterbore 37 is provided to accept insulating member 24 which is also formed from a dielectric material, such as the synthetic resin polymer sold under the trademark Teflon, for example. Insulating member 24 is configured in the shape of a ring and includes a central opening 35 of sufficient diameter dimension to receive the annular insulating layer 13 which encircles center conductor 12. With this construction, it is assured that the center conductor 12 and the center contact pin 22 are insulated from the metallic body of the connector 10. The insulating member 23 is sufficiently held in place within the connector for assembly by a continuous circumferential indentation at 36 in the forward end 16 of the connector 10.

The rearward end 17 of connector 10 includes a rearward opening 40 which is generally cylindrical, and which houses a cable clamping means comprising an annular ring 41 and clamping ring 42, a force applying means comprising a rigid hollow member 43 which is preferably formed in the shape of a hollow cylinder and which has coated thereon compressible material 44, and a force generating means comprising a rear clamping nut 45, an inner threaded portion 46 on the surface of opening 40, and a washer 47.

Annular ring 41 abuts the shoulder portion 50 and is thus stationary relative to the forward direction of the connector. Ring 41 also includes a central opening 51 of sufficient dimension to allow the central conductor 12 and the annular insulating layer 13 to pass therethrough towards the forward end of the connector. The ring 41 is preferably formed from a conductive material such as brass or stainless steel to effect electrical connection of outer conductor 14 to the metallic body of the connector which comprises the outer contact of the connector.

Clamping ring 42 is spaced axially from ring 41 so that the outer conductor 14 may be disposed between the clamping ring 42 and the stationary ring 41. The clamping ring 42 is preferably formed so that the outer conductor 14 may be wrapped around its forward end to be securely held by the rings 41 and 42 responsive to the application of an axial pressure to clamping ring 42. Clamping ring 42 also includes a central opening 52 which is dimensioned to receive the outer conductor 14 of cable 11 and a counterbore 53 forming a shoulder 54 which receives the outer dimension of cable 11 whereupon the insulating cover 15 of cable 11 abuts the shoulder 54. The clamping ring 42 is preferably formed from brass or stainless steel.

Figure 2:
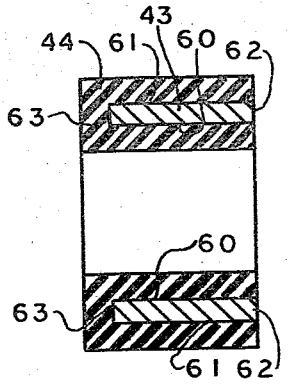
FIG. 2 is a cross-sectional view of a principal component of the connector of FIG. 1 which embodies the present invention.

The rigid cylindrical member 43 applies the required axial force to clamping ring 42 to cause the clamping ring 42 and ring 41 to securely hold the outer conductor 14 of cable 11 for retaining the cable 11 within the connector. The cylinder 43, in accordance with the present invention, as best seen in FIG. 2, includes an inner surface 60, an outer surface 61, and peripheral end surfaces 62 and 63. The inner surface 60, outer surface 61, and one end surface such as end surface 63, are coated with compressible material 44 such as rubber. Of particular importance is the fact that the compressible material 44 covers the inner and outer surfaces of cylinder 43 and extends beyond one of its peripheral end surfaces. As will be explained more fully hereinafter, the compressible material 44 is compressed by the axial force received by cylinder 43 which it in turn applies to the clamping ring 42 so that the compressible material 44 seals the cable-connector terminations and the interior of the connector from the external environment.

Referring again to FIG. 1, it can be seen that the cylinder 43 is mounted within the opening 40 in coaxial relation and the inner dimension of the compressible material allows the coaxial cable 11 to pass therethrough. The coating of compressible material on cylinder 43 is provided with a thickness such that the cylinder and its compressible material may be fitted into the rear portion of the connector without substantial compression of the compressible material by the walls of opening 40. Thus, a gap is shown at 65 for illustrative purposes, and it must be understood, that the gap 65 is shown exaggerated for purposes of illustration.

As mentioned earlier, the rear clamping nut 45, the inner threaded portion 46 of opening 40, and the washer 47 generate the required axial force to cause the clamping means comprising clamping ring 42 and ring 41 to clamp and securely hold the outer conductor or braid 14 of the coaxial cable 11 and to cause the compressible material 44 to be compressed to provide the necessary sealing of the connector. To that end, the clamping nut 45 includes an external thread 70 which cooperates with the internal thread 46 so that as the clamping nut 45 is rotated relative to the connector body, it moves axially within the rear opening 40 of the connector. As a result, the axial force is generated.

The washer 47 includes a central opening 71 of sufficient dimension to allow the cable 11 to pass therethrough and is provided for the purpose of preventing the rotational movement of clamping nut 45 from being applied to the compressible material 44. This result obtains because there is less resistance to rotation at the interface of clamping nut 45 and washer 47 than between the interface of washer 47 and compressible material 44. The clamping nut 45 and washer 47 may be formed from brass or stainless steel, with brass being preferred where cost is of importance.

Figure 3:
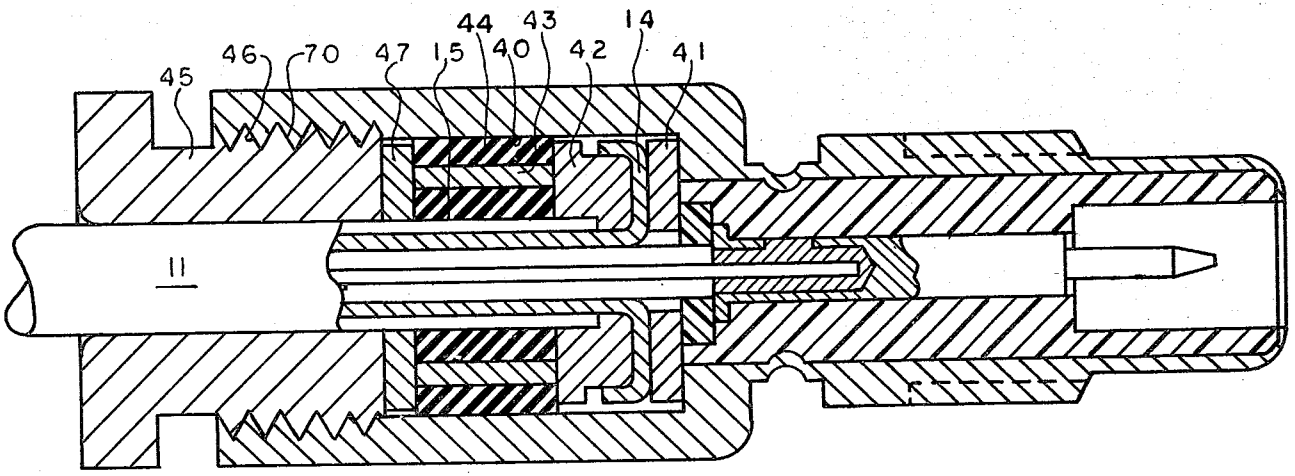
FIG. 3 is another cross-sectional view of the coaxial cable connector of FIG. 1 showing the relation of its component parts after a cable has been terminated to the connector.

In operation, the cable 11 is prepared and assembled in relation to the component parts of the connector as shown in FIG. 1. The clamping nut 45 is then rotated so that it moves from its axial position shown in FIG. 1 to its axial position shown in FIG. 3. As the clamping nut is rotated relative to the connector body, it moves axially within opening 40 towards the forward end of the connector and, through washer 47, imparts an axial force against compressible material 44. The cylinder 43 bears against clamping ring 42 which in turn bears against the outer conductor 14 and stationary ring 41 so that its rear peripheral edge 63 cuts through the compressible material until the peripheral edge 63 abuts the washer 47. As the peripheral edge 63 cuts through the compressible material, the compressible material is compressed by the axial force such that it expands or is compressed uniformly against the surface of opening 40 and the outer insulating jacket 15 of coaxial cable 11. As a result, the interior of the connector and the cable-connector interconnections are sealed from the external environment.

After the cylinder 43 has entirely cut through the compressible material 44 such that the peripheral edge 63 is in abutment with washer 47, continued rotation of clamping nut 45 will cause the cylinder 43 to impart the axial force to clamping ring 42. As a result, the clamping ring 42 and stationary ring 41 will securely hold the outer conductor 14 between these two parts with sufficient force that exceeds the tensile strength of the outer conductor 14 to assure that the cable 11 is fully and completely retained and securely held by the connector.

Even though the compressible material 44 is cut through by cylinder 43 after the termination between the cable and the connector is completed, the connector of the present invention is readily field serviceable. Should it ever be necessary to service the cable-connector termination, all that is necessary to disassemble the connector is to simply rotate clamping nut 45 so that it moves axially towards the rear of the connector until it is removed. As a result, the compressible material 44 will expand towards its original configuration beyond the edge 63 of the cylinder 43. Once the field servicing is completed, the connector may be reassembled in the same manner as previously described. As the retaining nut 45 is once again rotated to apply the axial force against the compressible material, even though the compressible material has already been cut by cylinder 43, it will still expand in the previously described manner to seal the connector from the external environment.

From the foregoing, it can be appreciated that the present invention provides an improved coaxial cable connector which includes a minimum number of component parts for achieving not only a low resistance connection of the conductors of the cable to the contacts of the connector, but also retention of the cable within the connector and sealing of the cable-connector interconnections and the interior of the connector component parts from the external environment. Because only relatively few component parts are utilized, the connector of the present invention is easily field serviceable. Also, because of the relatively few component parts, the connector of the present invention is particularly applicable for use in smaller size connectors wherein cable retention and sealing has heretofore been difficult, if not impossible, to attain. The connector of the present invention also provides a considerable cost savings owing to the fact that it consists of relatively few component parts.

While a particular embodiment of the invention has been shown and described, modifications may be made, and it is intended in the appended claims to cover all such modifications as may fall within the true spirit and scope of the invention.

I claim:

1. A coaxial connector for a coaxial cable having an inner conductor encircled by an annular insulating layer, an outer conductor, and an insulating jacket comprising:

a conductive body having an opening therein for receiving said coaxial cable, said opening being defined by an inner surface within said conductive body;

force generating means for providing an axial force within said opening;

clamping means for securely holding said outer conductor within said opening, said clamping means being responsive to said axial force provided by said force generating means; and force applying means including a rigid hollow member having an inner surface, an outer surface and two peripheral end surfaces for transmitting said axial force from said force generating means to said clamping means to cause said clamping means to securely hold said outer conductor, said rigid hollow member being disposed relative to a compressible member such that said compressible member substantially conforms to said inner surface, said outer surface and at least one of said peripheral end surfaces, said compressible member communicating with said coaxial cable and said inner surface of said conductive body such that said axial force axially compresses and radially expands said compressible member to provide a seal between said coaxial cable and said inner surface of said conductive body, said compressible member being integral with said rigid hollow member before and during use and remaining integral with said rigid hollow member after use such that said rigid hollow member can be reused without replacement of said compressible member.

2. The coaxial connector as defined in claim 1 wherein said rigid hollow member comprises a cylinder.

3. The coaxial connector as defined in claim 2 wherein said opening in said conductive body is generally cylindrical, wherein said compressible member is dimensioned for receiving said coaxial cable therethrough and wherein said opening in said conductive body is dimensioned for receiving said force applying means in coaxial relation.

4. The coaxial connector as defined in claim 3 wherein said clamping means comprises a stationary surface and an annular ring spaced apart from said stationary surface for receiving said outer conductor therebetween.

5. The coaxial connector as defined in claim 4 wherein said force applying means is located between said annular ring and said force generating means.

6. The coaxial connector as defined in claim 5 wherein said force generating means comprises a threaded portion of said inner surface of said conductive body and a cooperating rotatable threaded member dimensioned to be received by said threaded portion, said force generating means generating said axial force as said threaded member rotates relative to said conductive body.

7. The coaxial connector as defined in claim 6 wherein said force generating means further includes a washer between said threaded member and said force applying means to prevent rotational movement of said threaded member from acting upon said force applying means whereby only axial force is received by said force applying means.

8. A coaxial connector for a coaxial cable having an inner conductor encircled by an annular insulating layer, an outer conductor, and an insulating jacket comprising:

a metallic body having a forward end and a rearward end, said metallic body having an opening in said rearward end for receiving said coaxial cable, said opening being defined by an inner surface within said metallic body;

and end member within said opening and movable axially within said metallic body for providing an axial force;

clamping means within said opening including a stationary member and a clamping member adapted for receiving said outer conductor therebetween and for securely holding said outer conductor responsive to application of said axial force to said clamping member by said end member; and a rigid hollow member between said end member and said clamping member for transmitting said axial force to said clamping member for causing said clamping means to securely hold said outer conductor, said rigid hollow member including an inner surface and an outer surface and having a pair of peripheral end surfaces, said rigid hollow member being disposed in snug fitting relationship within a compressible member surrounding said inner surface, said outer surface and at least one of said peripheral end surfaces, said compressible member being axially compressed and radially expanded by said axial force to provide a tight seal between said inner surface of said metallic body and said coaxial cable, said compressible member being integral with said rigid hollow member before and during use and remaining integral with said rigid hollow member after use such that said rigid hollow member can be reused without replacement of said compressible member.

9. The coaxial connector as defined in claim 8 wherein said rigid hollow member is formed from metal.

10. The coaxial connector as defined in claim 8 wherein said inner surface of said metallic body includes an inner threaded portion and wherein said end member includes an outer threaded portion, said inner and outer threaded portions cooperating with one another, said end member being rotatable relative to said metallic body causing said end member to move axially within said opening for generating said axial force.

11. The coaxial connector as defined in claim 10 further comprising an annular ring between said end member and said rigid hollow member for preventing rotational movement of said end member from acting upon said rigid hollow member whereby only axial force is received by said rigid hollow member.

12. The coaxial connector as defined in claim 8 wherein said forward end of said metallic body comprises an outer contact for said outer conductor and wherein said stationary member is metallic and bears against said body for providing electrical connection between said outer conductor and said metallic body.

13. The coaxial connector as defined in claim 12 wherein said forward end of said metallic body further includes a center contact insulated from said body and wherein said stationary member includes a bore dimensioned for passing said inner conductor and said annular insulating layer therethrough towards said forward end of said metallic body to facilitate electrical connection of said inner conductor to said center contact.

14. A coaxial connector for a coaxial cable having an inner conductor surrounded by an insulating layer, an outer conductor, and an insulating jacket comprising:

a conductive body having an opening therein for receiving said coaxial cable, said opening being defined by an inner surface within said conductive body;

force generating means for providing an axial force within said opening;

clamping means for securely holding said outer conductor within said opening, said clamping means being responsive to said axial force provided by said force generating means; and force applying means including a compressible member disposed between said force generating means and said clamping means, said compressible member being disposed in snug fitting relationship substantially about a rigid hollow member, said rigid hollow member having an inner surface and an outer surface and having one end surface adjacent said force generating means and another end surface adjacent said clamping means, said inner surface, said outer surface and at least one of said end surfaces being coated with compressible material, said compressible material coating comprising said compressible member, said rigid hollow member being disposed such that said surrounded end surface cuts through said compressible member in response to said axial force being provided by said force generating means, said compressible member expanding within said opening in said conductive body to provide a tight seal between said coaxial cable and said inner surface of said conductive body, said rigid hollow member abutting said clamping means and said force generating means to apply said axial force to said clamping means to securely hold said outer conductor responsive to said axial force, said compressible member thereafter being maintained in snug fitting relationship about said rigid hollow member, said force applying means being reuseable to again provide a tight seal between said coaxial cable and said inner surface of said conductive body even after said end surface of said rigid hollow member has cut through said compressible member.

* * * * *